United States Patent [19]

Geiger et al.

[11] 4,064,887

[45] Dec. 27, 1977

[54] UPPER LEVEL WASH ARM SYSTEM

[75] Inventors: Paul B. Geiger; Ernst Grunewald; Ben J. Vallor, all of Troy, Ohio

[73] Assignee: Hobart Corporation, Troy, Ohio

[21] Appl. No.: 708,926

[22] Filed: July 27, 1976

[51] Int. Cl.[2] ..... B08B 3/02

[52] U.S. Cl. ..... 134/144; 134/163; 134/165; 134/177; 211/41; 312/351

[58] Field of Search ..... 134/144, 145, 148, 151–152, 134/163, 165, 176–177, 179; 211/41; 312/351

[56] References Cited

U.S. PATENT DOCUMENTS

| | | | |
|---|---|---|---|
| 2,035,625 | 3/1936 | Walker | 134/176 X |
| 2,648,588 | 8/1953 | Ruspino | 211/41 X |
| 3,070,104 | 12/1962 | Faust et al. | 134/145 |
| 3,115,352 | 12/1963 | Heerlein | 134/177 X |
| 3,207,167 | 9/1965 | Edstrom | 134/144 |
| 3,463,173 | 8/1969 | Goldman | 134/145 |
| 3,511,252 | 5/1970 | Kennedy | 134/145 |
| 3,538,927 | 11/1970 | Wallgren | 134/144 |
| 3,809,106 | 5/1974 | Crabtree | 134/176 |

*Primary Examiner*—Robert L. Bleutge

[57] ABSTRACT

A rotating spray arm is supported by a removable and vertically adjustable upper rack of a dishwasher. The fluid coupling for the spray arm is not affected by changes in the upper rack vertical position. The spray arm is also protected by a guard which forms a stand for the rack when removed from the dishwasher.

10 Claims, 13 Drawing Figures

UPPER LEVEL WASH ARM SYSTEM

BACKGROUND OF THE INVENTION

This invention relates to dishwashing machines, and more particularly to a wash arm and wash arm guard for a removable, vertically adjustable upper rack of a domestic dishwashing machine.

Many prior art spray members are specially designed to assure a spray of washing fluid for dishes in the upper rack. In some cases, these spray members are attached directly to the upper rack; in others they are mounted elsewhere. Some of these structures include a wireform cage or other barrier to discourage contact between the fluid distributing member and the dishes in the dishwasher racks.

It is widely recognized that extended spray arms are among the most effective for distributing fluid spray within a dishwasher. In domestic dishwashers such arms are preferably rotatable since the dishes are stationary. This maximizes the exposure of the dishes to the high velocity washing spray from many different angles of incidence. Such rotating spray arms are now all but universal for the lower spray members of domestic dishwashers, but are less commonly found for the upper rack. Such an upper rack spray member should occupy as little space as possible and interfere as little as possible with movement of the racks and the loading of the dishes. Likewise it should not interfere with the proper function of any other features provided by the dishwasher.

SUMMARY OF THE INVENTION

Briefly, the present invention provides a rotating arm fluid spray or distribution member for a vertically adjustable upper rack of a dishwashing machine. In order to minimize space consumption, the spray arm is mounted directly to and carried on the bottom of the upper rack. A guard is therefore provided to protect dishes in the vicinity of the spray arm from contact with it, as it rotates. The guard is generally circular, is supported beneath the spray arm, has a radius somewhat smaller than that of the fluid spray arm, and is suspended from the upper rack to extend downwardly below the height of the spray arm. Further, since the spray arm is attached to and carried by the upper rack, the guard is also designed to function as an integral stand for the upper rack. Thus, when the upper rack is removed from the dishwasher and placed on a counter top, the guard supports the rack and protects the fluid spray arm beneath it from damage.

The upper level rack of the present invention is moved in and out of the dishwasher tank on a pair of extendable rack tracks on opposite sides of the rack. The upper rack itself is connected to the rack tracks by a vertical adjustment mechanism which permits selective vertical adjustment of the position of the upper rack within the dishwasher tank. The extendible rack tracks and vertical adjustment means thus form a carriage means for mounting the upper rack for movement into and out of the dishwasher tank.

Since the upper rack is removable from the dishwasher tank, provision is made for coupling and uncoupling the upper rack spray member from the fluid recirculating system. A first coupling member is therefore supported in the rear of the dishwasher tank, and a second member is carried on the back of the upper rack for coupling to the first member to conduct fluid to the upper spray arm when the rack is in position within the dishwasher.

A potential problem might exist, however, in keeping the coupling members in proper mating relation with one another when the vertical position of the upper rack is adjusted. The present invention therefore provides a mounting strap which is supported on the upper rack wheels which roll on the extendible upper rack tracks. These tracks themselves do not shift vertically when the upper rack vertical position is changed. Therefore the second coupling member, which is mounted on the strap on the upper rack, is likewise unaffected by the specific vertical position of the rack itself. A flexible hose connects the second coupling member to the spray arm to accommodate differences in their relative vertical positions.

Proper coupling between the coupling members is facilitated by shaping the second coupling member as a funnel and the first as a bellows dimensioned for reception, in conjunction with a cone shaped locator, within the funnel. The fluid outlet in the end of the bellows is smaller than the internal dimensions of the bellows adjacent the outlet, so that the pressure of the fluid inside the bellows biases it against the funnel as the fluid is conducted therethrough. This pressure helps maintain the seal between these coupling members.

The vertical adjustment mechanism for the upper rack is inaccessible for adjustment when the upper rack is in position within the dishwasher tank. One function of the guard, as explained, is to assure that the dishes and spray arm will be protected from one another. Otherwise dishes might be chipped or broken by the spray member, or the dishes might prevent the spray member from rotating for proper washing action. However, if the dishes and guard clear one another as the rack is moved into position on the extendable rack tracks, then there should normally be no interference. Since the vertical adjustment mechanism is then inaccessible, the operator is prevented from subsequently adjusting the rack to a dish breaking or interferring level.

It is therefore an object of the present invention to provide an upper level wash arm system for a dishwashing machine in which the wash arm is carried on the upper rack and the upper rack is vertically adjustable; which includes fluid coupling members which automatically compensate for changes in the vertical position of the upper rack without requiring adjustment by the machine operator; in which the positions of the fluid coupling members are essentially unchanged when the vertical position of the upper rack is adjusted; which includes a guard which protects dishes in the vicinity of the spray member and which forms an integral stand to support the upper rack and protect the spray arm when the rack is removed from the dishwasher; which prevents the upper rack from being adjusted after the dishes and guard have cleared one another upon insertion of the upper rack into the dishwasher; and to accomplish the above objects and purposes in an inexpensive, uncomplicated, highly durable and reliable configuration which is well suited to economical mass production.

Other objects and advantages of the invention will be apparent from the following description, the accompanying drawings and the appended claims.

DESCRIPTION OF THE PREFERRED EMBODIMENT

Figure 1:
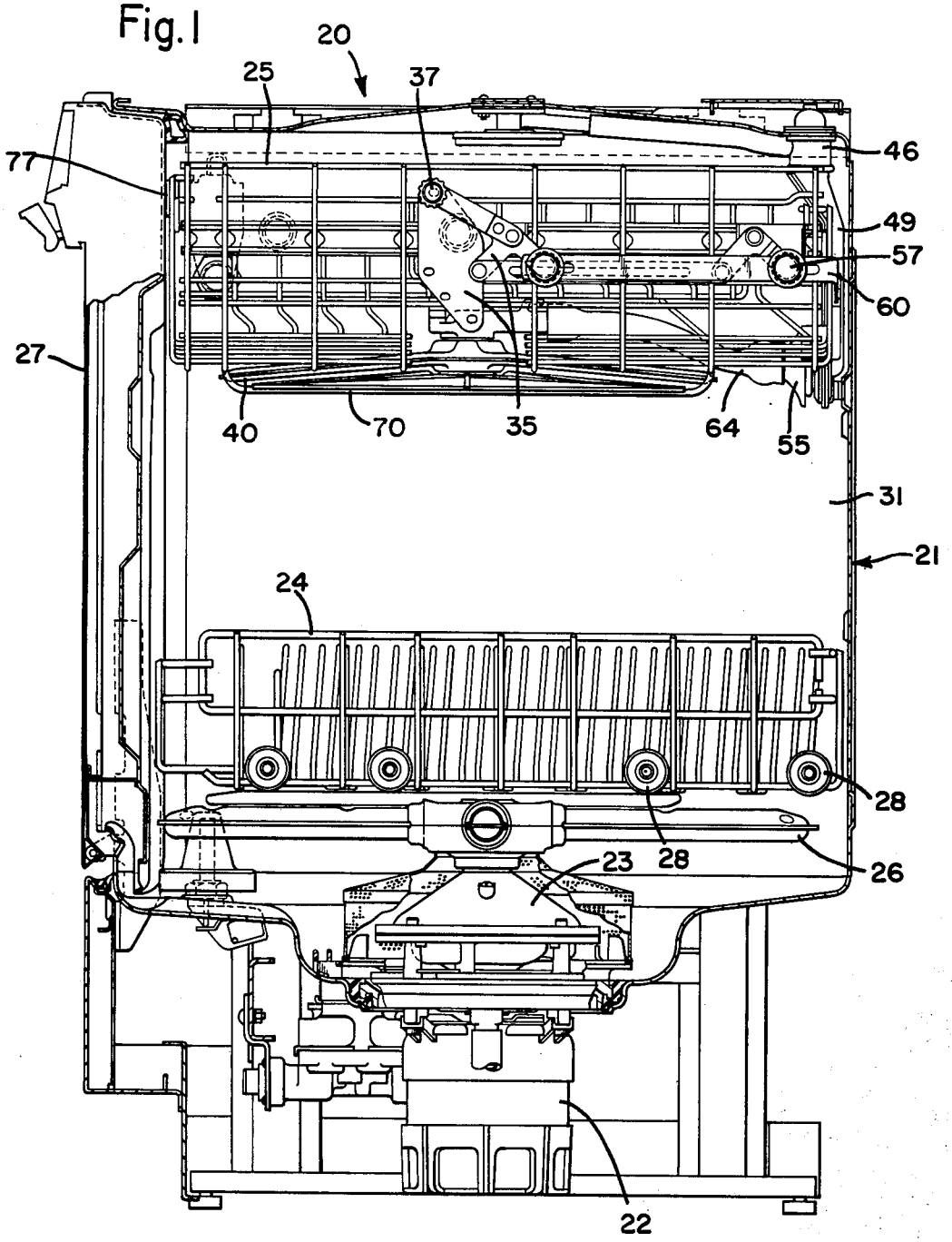
FIG. 1 is a partially broken away side cross sectional view of a domestic dishwasher incorporating the upper rack spray arm and guard of the present invention, portions of the dishwasher having been omitted for clarity of illustration.
Figure 2:
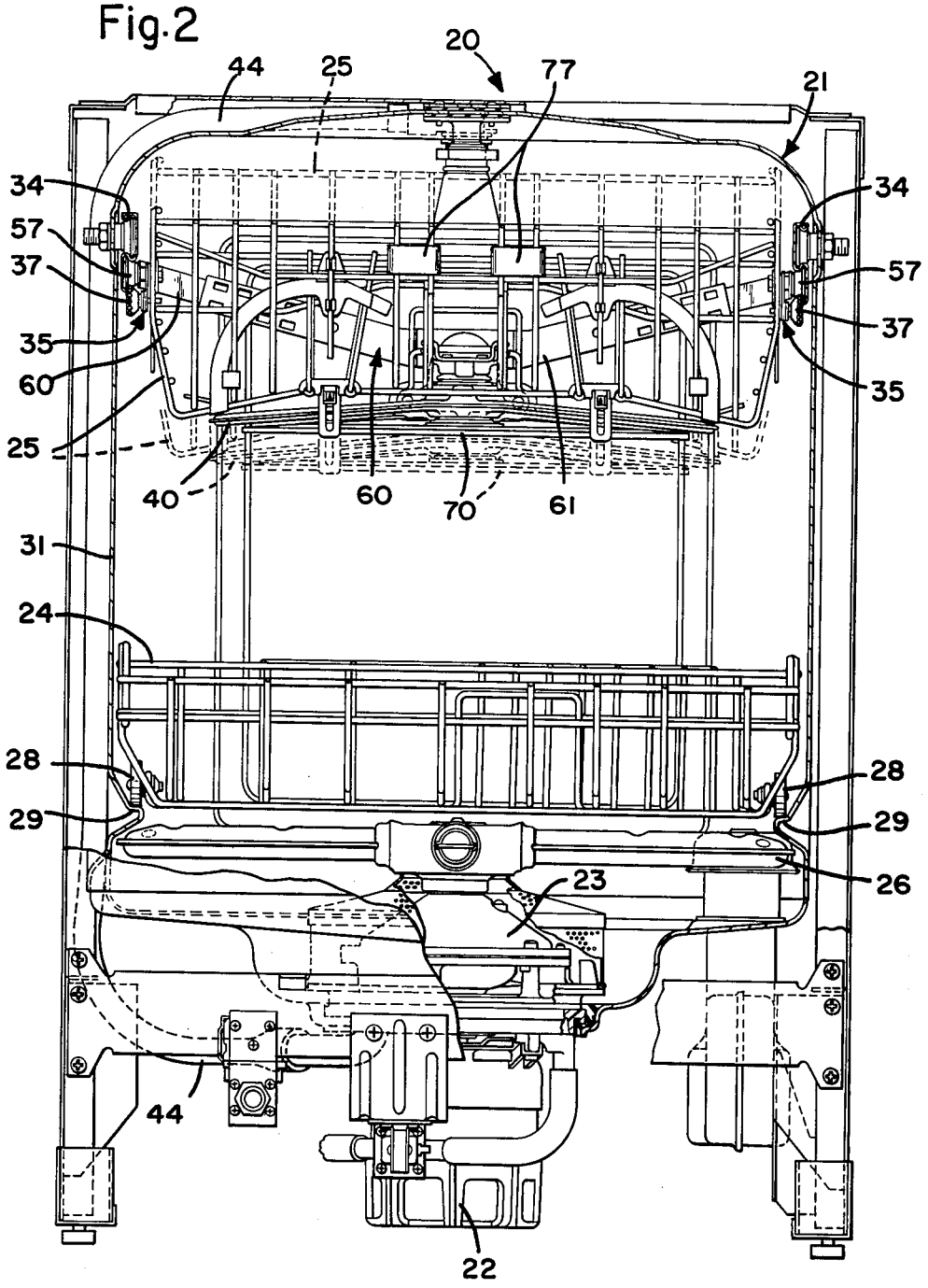
FIG. 2 is a partially broken away front cross sectional view of the dishwasher illustrated in FIG. 1, the intermediate position of the upper rack being shown in solid line and the upper and lower positions being illustrated in phantom.

The dishwasher 20 illustrated in FIG. 1 includes a tank 21, recirculating pump motor 22, recirculating pump 23, lower and upper dish supporting racks 24 and 25, a lower wash arm 26 having four spray tubes and being rotatably supported on pump 23, and a door 27 on the front of dishwasher 20 for providing access to the dishwasher tank 21. The lower rack has wheels 28 which support the rack for movement into and out of the dishwasher tank 21 on the tracks 29 (FIG. 2) formed in the side walls 31 (FIG. 2) of tank 21.

The upper rank 25 is likewise mounted for movement into and out of the dishwasher tank 21 through its front. The upper rack is supported by a pair of extendable rack tracks 34 mounted in the side walls 31 of tank 21, at opposite sides of upper rack 25. Tracks 34 form part of a carriage which mounts the upper rack for movement into and out of the dishwasher tank, and which includes a pair of vertical adjustment assemblies 35 which are supported by tracks 34 and connect the upper rack 25 to the tracks 34. Assemblies 35 include adjustment knobs 37 which permit the height of each side of the rack 25 to be adjusted independently. This mechanism is described in detail in U.S. Pat. No. 3,472,573 (Geiger, issued Oct. 14, 1969), assigned to the assignee of the present invention. Further description of the vertical adjustment assemblies 35 is therefore not given here, it being sufficient to say that as each knob 37 is moved upwardly, the side of the rack corresponding thereto will also move upwardly, and vice versa. Of course, the vertical positions of the tracks 34 are not affected by movement of the adjustment knobs 37.

Figure 4:
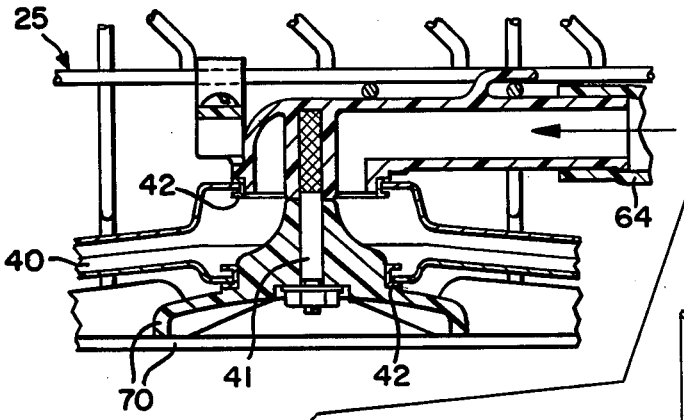
FIG. 4 is an enlarged fragment in cross section showing the mount and pivot for the upper spray arm.

An upper level fluid spray wash arm 40 is mounted on upper rack 25 by a shaft 41 (FIG. 4) which supports a guard 70 and a bearing 42, mounted thereon. Bearing 42 supports the upper wash arm 40 for rotation thereon, the upper wash arm 40 thus moving upwardly and downwardly with the upper rack 25. Its position within dishwasher 20 is accordingly a function of the vertical position of the upper rack 25, and it always remains the same distance from the rack.

In operation, the recirculating pump 23 discharges wash fluid into the lower wash arm 26 and into a fluid conduit 44 which conducts the fluid to a coupling 46 at the upper rear of the dishwasher tank 21. Coupling 46 supplies fluid to a small rotating top wash arm 47 and a manifold 49. Manifold 49, in turn, conducts the fluid to a bellows coupling member 50 supported on the rear wall of dishwasher tank 21.

Figure 5:
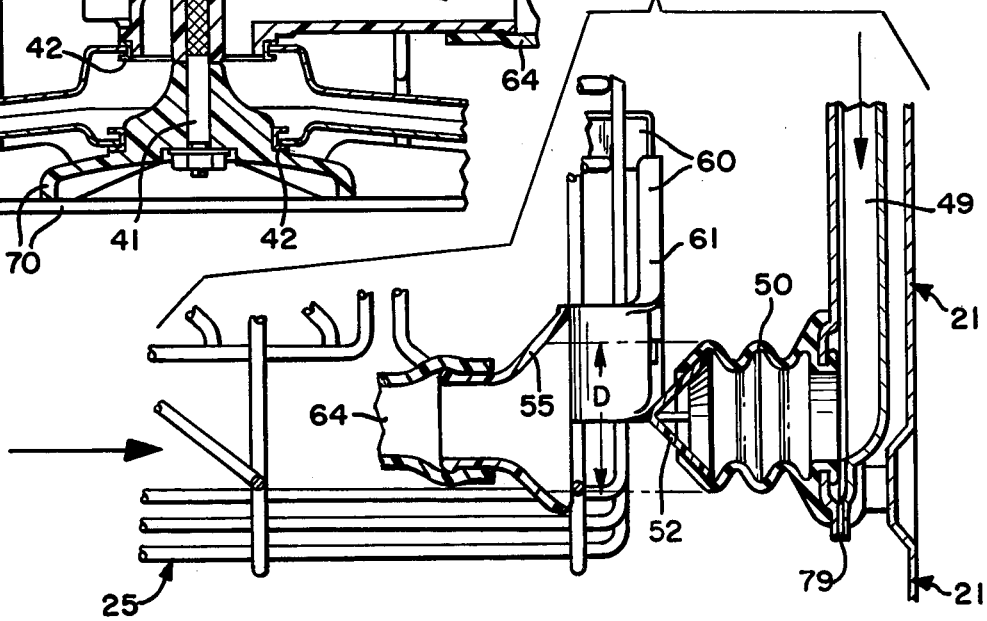
FIG. 5 is a detail partially in section illustrating the operating relations of the fluid coupling members.

A perforate, cone shaped locator 52 is captured in the outlet end of the bellows coupling member 50 opposite manifold 49. The cross-sectional area of the passages through locator 52 is less than that defined by the maximum diameter D (FIG. 5) of the bellows immediately adjacent and upstream from locator 52. Fluid pressure within bellows 50 therefore tends to extend the bellows, biasing it against a funnel shaped coupling or receiving member 55 which is supported on the upper rack wheels 57.

The upper rack wheels 57 are part of the extendible rack tracks 24, and are therefore always at a constant vertical height within the dishwasher. Wheels 57, in turn, carry the upper rack 25 by means of the vertical adjustment assemblies 35, the upper rack wheels thereby being a part of, and being attached to, the upper rack 25. Since the vertical positions of the wheels 57 are fixed, a mounting strap 60 is supported upon the wheels, and the funnel shaped coupling member 55 is formed as an integral portion of the center member 61 of strap 60. Thus the coupling member 55 is mounted on the upper rack at substantially a constant vertical height within the dishwasher tank. This height is selected, of course, to correspond with that of the bellows coupling member 50 and the cone shaped locator 52 so that they can couple to one another independently of the vertical position of the upper rack 25.

Figure 3:
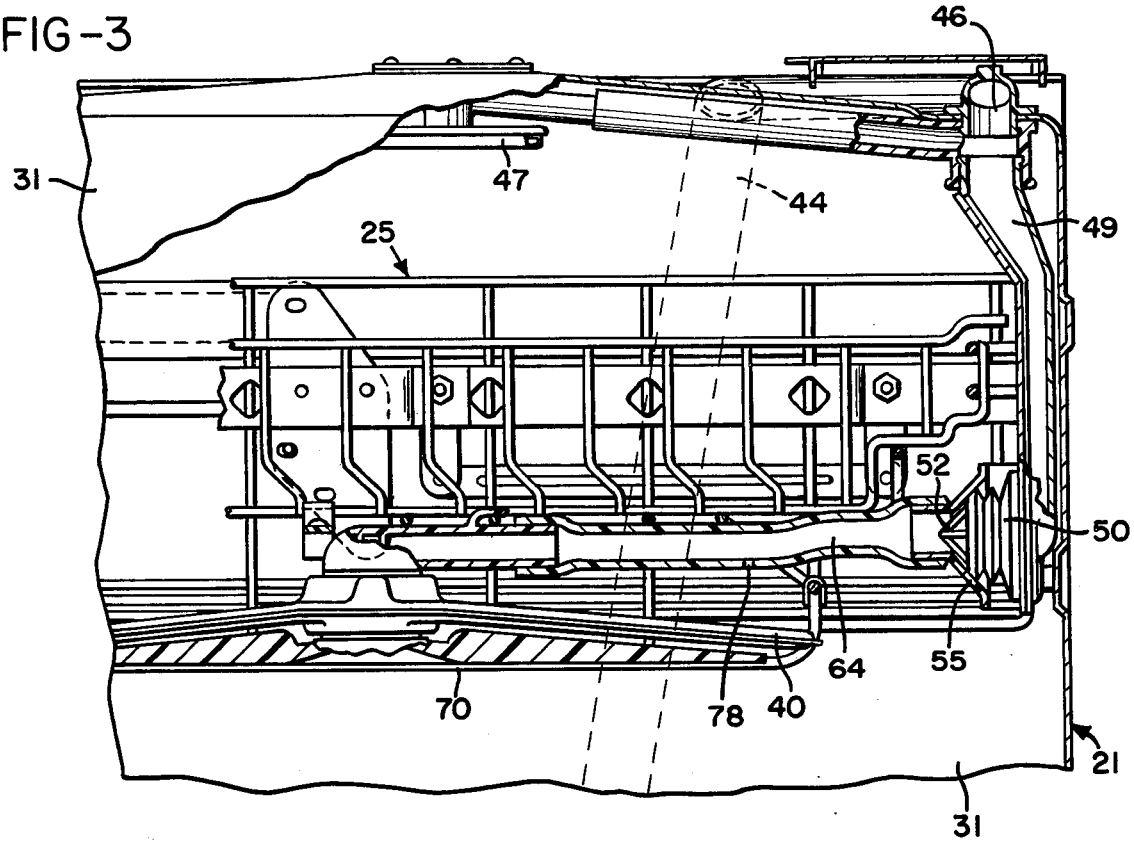
FIG. 3 is an enlarged side view, partially in section, of the rear portion of the upper rack, showing the fluid coupling and conducting system.
Figure 12:
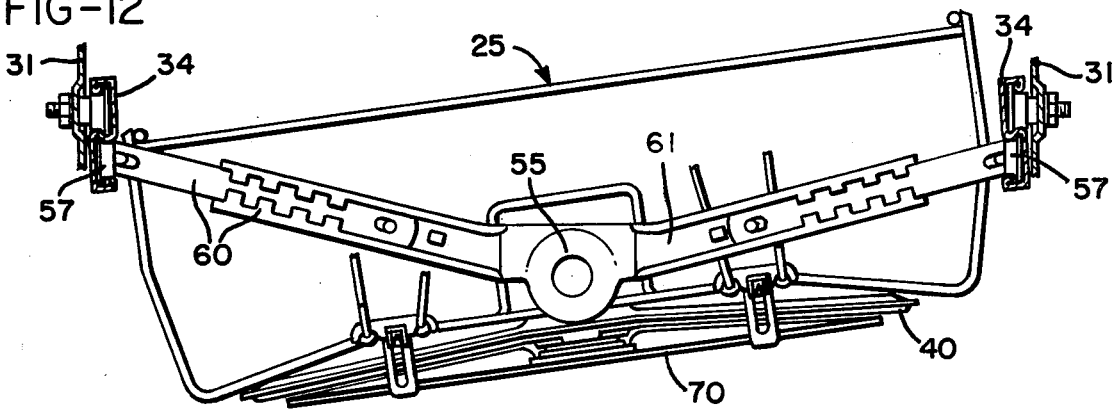
FIG. 12 is a view similar to FIG. 10 showing the rack adjusted to a tilted position by its vertical adjustment mechanism.

Since the funnel shaped coupling member 55 is maintained at a constant vertical height, but the position of the upper wash arm 40 may be changed vertically and/or rotated (FIG. 12), a flexible hose 64 connects the upper wash arm 40 and the funnel shaped coupling member 55. Hose 64 readily compensates for differences in the relative positions between arm 40 and member 55. Further, the coupling members 50 and 55 are positioned vertically just below the mid point between the highest upper rack position (FIG. 1) and the lowest (FIG. 3) to save space by minimizing the net vertical clearance required for hose 64.

Figure 6:
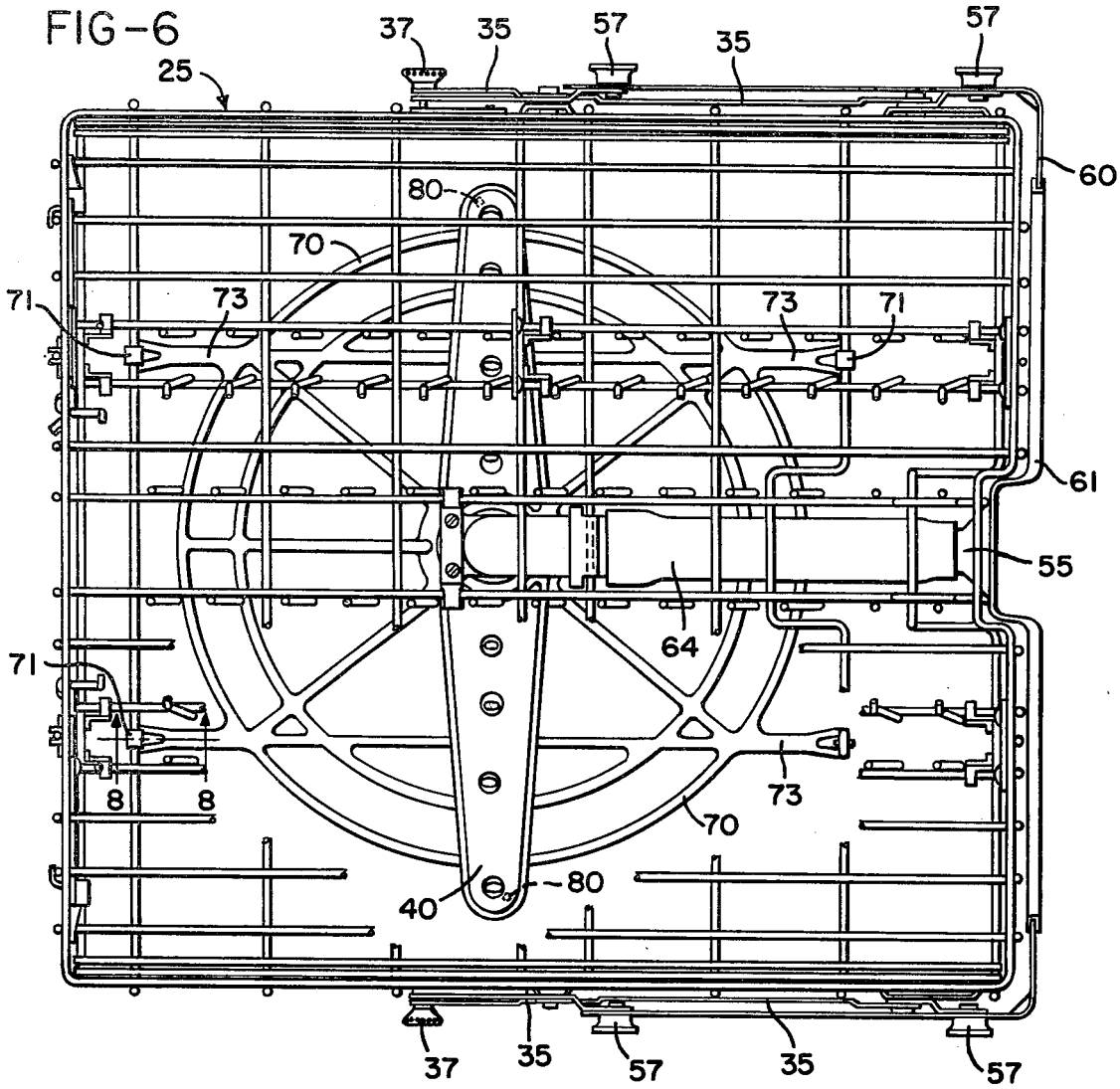
FIG. 6 is a partially broken away plan view of the upper level rack.
Figure 7:
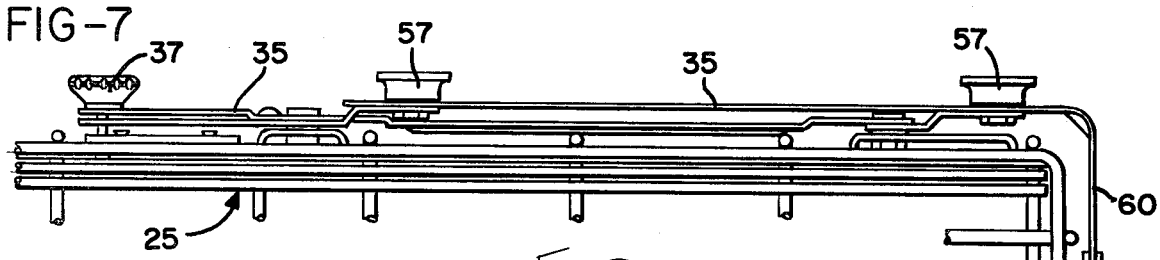
FIG. 7 is an enlarged detail of the rack carriage shown in FIG. 6.
Figure 8:
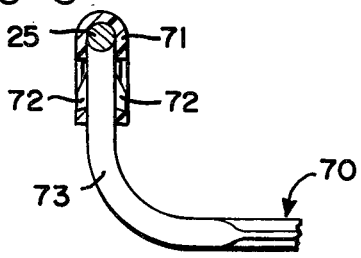
FIG. 8 is a section taken on line 8—8 of FIG. 6.
Figure 9:
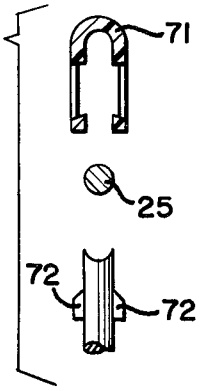
FIG. 9 is an exploded view of the members illustrated in FIG. 8.
Figure 9:
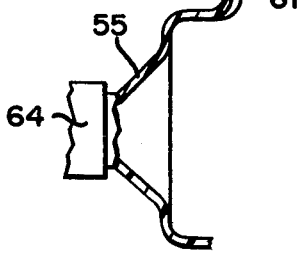
Figure 10:
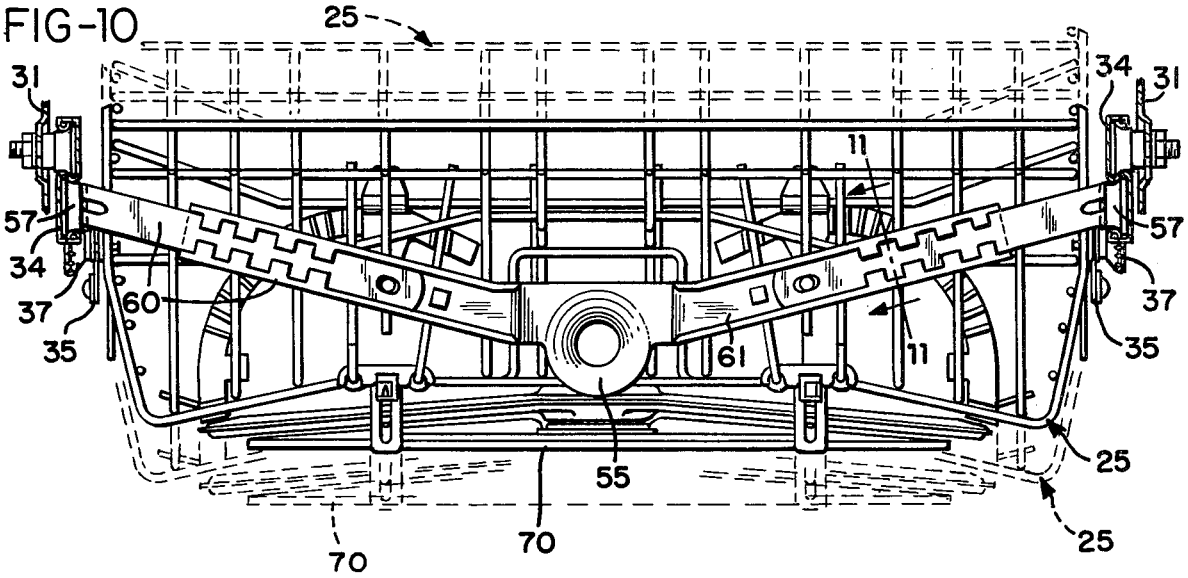
FIG. 10 is a rear view of the upper level rack and carriage system, with the intermediate position shown in solid line and the upper and lower portions illustrated in phantom.
Figure 11:
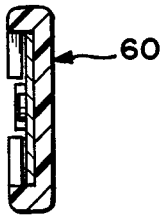
FIG. 11 is a section on line 11—11 of FIG. 10.
Figure 13:
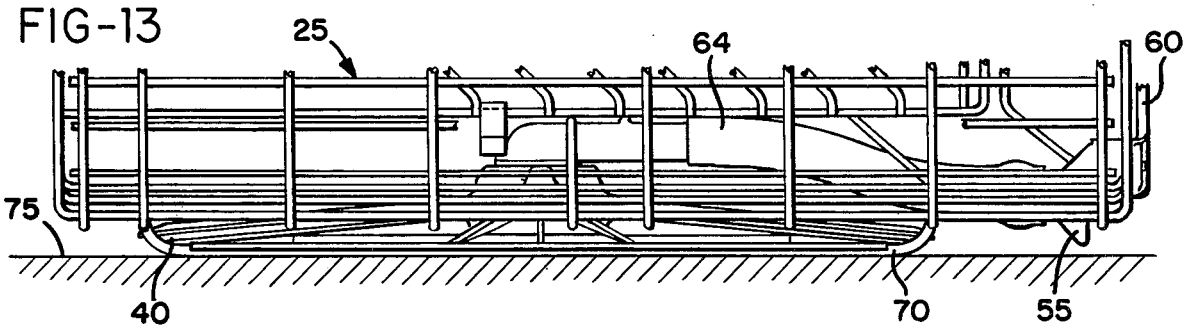
FIG. 13 illustrates a portion of the rack resting upon a counter top, with the guard supporting the rack and protecting the upper level wash arm.

Guard 70 substantially surrounds the upper wash arm 40 and is partially supported by shaft 41. Guard 70 is also supported on upper rack 25 by clips 71 (FIGS. 6, 8, and 9) which engage barbs 72 onthe mounting arms 73 of guard 70. Guard 70 extends downwardly below the height of upper wash arm 40, and, as shown in FIG. 6, is of a generally circular configuration having a radius a little less than, but similar to, that of the upper wash arm 40. Guard 70 is thus supported on the upper rack 25 beneath the upper wash arm 40 to protect dishes in the vicinity thereof from contact with the upper wash arm as it rotates. Also, as illustrated in FIG. 13, guard 70 is shaped to serve as an integral stand to support the upper rack 25 and protect the upper wash arm 40 when the upper rack is removed from the dishwasher and placed on some surface, such as a counter top 75.

With reference to FIGS. 1 and 6, it is clear that the adjustment knobs 37 of the vertical adjustment assemblies 35 are located well back along the sides of the upper rack 25. Thus, when the upper rack is mounted in operating position in the dishwasher (FIG. 1), the adjustment knobs 37 are inaccessible to the machine operator. When the rack is first inserted, the guard 70 will encounter dishes in lower rack 24 which might interfere with proper rotation of the upper wash arm 40. The machine operator should then make the adjustments necessary in response to this warning from the guard 70, and then reinsert the rack. The location of adjustment knobs 37 then prevents the rack from being subsequently adjusted (downwardly) to a position where dishes might extend upwardly through the openings in the guard to interfere with the upper wash arm 40. This helps to assure proper clearance at all times.

In operation, the dishwasher is loaded, the position of the upper rack is adjusted as desired, and then the upper rack is inserted into its operating position as illustrated in FIG. 1. The coupling members 50 and 55 are guided into proper engagement by the locator 52 regardless of the settings of the vertical adjustment assemblies 35. Thus, as the dishwasher door 27 is closed, it engages bumpers 77 (FIG. 1) on the front of upper rack 25 to push the upper rack rearwardly to drive the funnel shaped coupling member 55 firmly over the cone shaped locator 52 within bellows coupling member 50. This is advantageous since the funnel shaped coupling member 55 may not always be properly centered. That is, although hose 64 is flexible, it can still pull member 55 slightly off center (up, down, or sideways) in certain rack positions. If this happens, locator 52 then pulls the funnel shaped coupling member 55 back into position during the last part of the coupling motion. This occurs as the bellows 50 compresses and stiffens, thereby pulling the funnel back to its center location. Accordingly, mounting strap 60 is made sufficiently flexible to accommodate these centering motions.

After the door 27 is closed, the wash and rinse fluids are introduced, recirculated, and sprayed on the articles in the racks, as discussed above, following which the dishes are dried in conventional manner. Drain holes 78, 79, and 80 in hose 64 (FIG. 3), manifold 49 (FIG. 5), and upper wash arm 40 (FIG. 6), respectively, drain the remaining fluids from the upper wash arm and conduits during each drain period so that water will not be held and possibly spilled on the contents of the lower rack when the upper rack is extended after the dishes have been dried.

Ordinarily, the upper rack is not completely removed from the dishwasher, but merely extended on the tracks 34 for loading and unloading. If desired, however, the entire upper rack 25 may be removed and the guard 70 then protects the upper wash arm 40 when the rack is supported outside the dishwasher independently of the upper rack wheels 57.

As may be seen, therefore, the present invention has numerous advantages. It provides a rotating wash arm beneath the upper rack of a dishwasher in which the upper rack is vertically adjustable. Proper coupling and uncoupling of the wash arm to and from the fluid recirculating system is assured regardless of the vertical position of the rack. This is done automatically and without any assistance or participation on the part of the machine operator. At the same time the structure is uncomplicated, durable, and highly reliable.

The invention also includes a guard which is designed to protect the upper wash arm from interference with dishes in the lower rack and to help prevent those dishes from breaking or chipping from contact with the upper wash arm as it rotates. The guard also provides a stand for the upper rack when it is removed from the dishwasher and helps protect the upper arm from damage when the rack is supported on a surface outside the dishwasher. The guard and vertical adjustment assemblies also cooperate to prevent the position of the upper rack from being adjusted after the upper rack is inserted into the dishwasher tank, so that the protective function of the guard is not defeated by subsequent manipulation of the rack height.

While the form of apparatus herein described constitutes a preferred embodiment of this invention, it is to be understood that the invention is not limited to this precise form of apparatus, and that changes may be made therein without departing from the scope of the invention.

What is claimed is:

1. In an upper level wash arm system for a dishwashing machine having a tank defining a cleansing chamber, a fluid recirculating pump having an inlet and an outlet, lower and upper racks supportable within the tank and movable horizontally between washing and extended positions, at least one fluid spray member, and vertical adjustment means mounting the upper rack for selective vertical adjustment of the washing position thereof within the dishwasher tank, the improvement comprising:

a. means mounting the fluid spray member on the upper rack for vertical movement therewith in response to vertical adjustment of the rack, b. a first coupling member supported in the dishwasher at a relatively fixed height in the tank, c. a conduit for conducting fluid from the pump outlet to said first coupling member, d. a second coupling member for engaging the first coupling member for receiving fluid therefrom when the upper rack is in any of the selected washing positions thereof within the dishwasher tank, e. means mounting said second coupling member on the upper rack at substantially a constant vertical height when the rack is in any of the selected washing positions within the dishwasher tank for enabling coupling to said fixed height first coupling member independently of the adjusted vertical position of the rack, and f. means for conducting fluid from said second coupling member to the fluid spray member and for compensating for possible differences in the relative vertical positions between said second coupling member and said spray member when the rack is in a washing position within the tank.

2. The system of claim 1 further comprising carriage means mounting the upper rack for movement into and out of the dishwasher tank, said second coupling member being attached to and supported by said carriage means, the vertical adjustment means for the upper rack being attached to and supported by said carriage means, and said coupling members being adapted to separate when the upper rack is moved outwardly from the dishwasher tank, and to couple for conducting fluid when the upper rack is in washing position within the dishwasher tank.

3. The system of claim 2 wherein said carriage comprises a pair of relatively fixed level extendable rack tracks, one each on opposite sides of the upper rack, and further comprising a mounting strap supportable between said rack tracks and supporting said second coupling member thereon.

4. The system of claim 1 wherein one of said coupling members is a generally funnel shaped member and the other coupling member is a bellows having a section shaped and dimensioned to mate with said funnel shaped coupling member.

5. The system of claim 4 further comprising a perforate cone shaped locator carried in the end of said bellows coupling member for guiding, pulling, and moving said coupling members into proper alignment during engagement thereof, wherein said second coupling member is said funnel shaped coupling member, and wherein said means mounting said funnel shaped coupling member on the upper rack provides for such movement of said funnel shaped coupling member into alignment with said bellows coupling member.

6. The system of claim 1 further comprising means mounting the upper rack for selective angular adjustment within the dishwasher tank, and wherein said second coupling member mounting means also maintains said second coupling member at substantially a constant angular position independently of the adjusted angular position of the rack.

7. In an upper level wash arm system for a dishwashing machine having a tank defining a cleansing chamber, lower and upper racks supportable within the tank, at least one generally horizontal fluid spray member supported on the upper rack for rotational movement therebeneath on a generally vertical axis as fluid is sprayed therefrom, and means mounting the upper rack for removal from the dishwasher, the improvement comprising:

guard means on the upper rack extending downwardly below the height of the spray member and substantially surrounding the sides and bottom of the spray member to protect dishes in the vicinity of the spray member from contact therewith as the spray member rotates, said guard means also forming an integral stand to support the upper rack and protect the fluid spray member when the upper rack is removed from the dishwasher.

8. The system of claim 7 wherein said guard is of generally circular configuration and has a peripheral portion of a radius similar to the horizontal extension of the fluid spray member from its axis of rotation.

9. In an upper level wash arm system for a dishwashing machine having a tank defining a cleansing chamber, a fluid recirculating pump having an inlet and an outlet, lower and upper racks supportable within the tank and movable horizontally between washing and extended positions, at least one fluid spray member, and carriage means mounting the upper rack for movement into and out of the dishwasher, the carriage means including a pair of extendable rack tracks and vertical adjustment means for selective vertical and angular adjustment of the upper rack within the dishwasher tank, the improvement comprising:

a. means mounting the fluid spray member on the upper rack for vertical movement therewith in response to vertical adjustment of the rack,
b. a bellows coupling member having a cone shaped located on one end thereof and supported at a fixed height within the dishwasher tank,
c. a conduit for conducting fluid from the pump outlet to said bellows coupling member,
d. a mounting strap supportable between the rack tracks,
e. a generally funnel shaped coupling member supported on said mounting strap at a substantially constant vertical height and angular position when the rack is in the washing position within the dishwasher tank for engaging the bellows coupling member for receiving fluid therefrom independently of the adjusted vertical and angular positions of the rack,
f. said bellows coupling member being shaped and dimensioned for reception within said funnel shaped coupling member, and said cone shaped locator guiding, pulling, and moving said coupling members into proper alignment,
g. flexible means for conducting fluid from said funnel shaped coupling member to the fluid spray member and to compensate for possible differences in the relative vertical positions between said funnel shaped coupling member and said spray member, and
h. a generally circular guard on the upper rack and having an outer periphery approximating that of the fluid spray member and extending downwardly beneath the fluid spray member to protect dishes in the vicinity of the spray member from contact therewith as the spray member moves, said guard also forming an integral stand to support the upper rack and protect the fluid spray member when the upper rack is removed from the dishwasher.

10. The system of claim 9 wherein the vertical adjustment means is carried by the extendable rack tracks at the sides of the upper rack and is accessible for adjustment only when the upper rack is extended outwardly of the dishwasher tank, thereby warning, by contact of said guard with articles supported in the lower rack upon returning the rack inwardly of the tank after a lowering adjustment of the upper rack, whether the rack has been lowered too far for the articles supported therebelow.

* * * * *